US006053780A

United States Patent [19]

Ono et al.

[11] Patent Number: 6,053,780

[45] Date of Patent: Apr. 25, 2000

[54] FUSIBLE LINK MOUNTING METHOD AND TERMINAL AND FUSIBLE LINK HOUSING USED IN THE SAME METHOD

[75] Inventors: Shuji Ono; Masaji Miyamoto, both of Shizuoka, Japan

[73] Assignee: Yazaki Corporation, Tokyo, Japan

[21] Appl. No.: 09/075,819

[22] Filed: May 12, 1998

[30] Foreign Application Priority Data

May 12, 1997 [JP] Japan ..... 9-120932
Dec. 19, 1997 [JP] Japan ..... 9-351619

[51] Int. Cl.[7] ..... H01R 4/36; H01R 11/11

[52] U.S. Cl. ..... 439/810; 439/883

[58] Field of Search ..... 439/621, 622, 439/752, 801, 810, 883

[56] References Cited

U.S. PATENT DOCUMENTS 4,900,259 2/1990 Ludwig et al. ..... 439/107
5,505,630 4/1996 Petrisko et al. ..... 439/137
5,575,697 11/1996 Kaedei ..... 439/883
5,816,850 10/1998 Yamada et al. ..... 439/507
5,997,341 12/1999 Ushiyama et al. ..... 439/480

FOREIGN PATENT DOCUMENTS 58-91878 6/1983 Japan ..... H01R 11/12
4-61837 5/1992 Japan ..... H01H 85/56
6-62466 9/1994 Japan ..... H01R 4/58

*Primary Examiner*—Neil Abrams
*Assistant Examiner*—Chandrika Prasad
*Attorney, Agent, or Firm*—Sughrue, Mion, Zinn, Macpeak & Seas, PLLC

[57] ABSTRACT

A fusible link mounting method in which a fusible link is mounted onto a fusible link housing, and a leg portion of the fusible link and a terminal of an electric wire are tightened and connected together by a bolt. In the method, the bolt is previously tightened provisionally with respect to the fusible link housing, after then, the terminal including a bridge portion so formed as to be able to pass outside a head portion of the bolt provisionally tightened is slid and inserted in a direction right angles to the bolt tightening direction in a separate step to thereby position a connecting portion of the terminal between the head portion of the bolt and the leg portion of the fusible link, and, next, the bolt is actually tightened to thereby connect the leg portion of the fusible link and the connecting portion of the terminal to each other.

6 Claims, 6 Drawing Sheets

FUSIBLE LINK MOUNTING METHOD AND TERMINAL AND FUSIBLE LINK HOUSING USED IN THE SAME METHOD

BACKGROUND OF THE INVENTION

1. Field of the Invention

The present invention relates to a method for mounting a fusible link of a threadedly mounting type requiring a high current characteristic, as well as a terminal and a fusible link which are respectively used in the same method.

2. Description of the Related Art

Conventionally, for example, there is known a fusible link box which allows a bolt clamping operation to be executed from the vertical direction of a fusible link housing. Now, describing the known fusible link box concretely with reference to FIG. 10, the fusible link box 1 includes a fusible link housing 2 formed of synthetic resin. The fusible link housing 2 includes a box-shaped front portion 2*a* in which the main body side of a fusible link 4 is to be stored and mounted, and a partition portion 2*b* which has an H-shaped cross section and also into which a pair of leg portions 4*a* and 4*a* (one of which is shown) of the fusible link 4 are to be inserted. In the upper and lower recessed portions of the partition portion 2*b*, there are respectively fitted nuts 5 each of which includes a square-plate-shaped lower portion and a cylindrically-shaped upper portion.

In a wire harness manufacturing process, after the fusible link 4 is set in the front portion 2*a* of the fusible link housing 2, a bolt 6 is engaged with and tightened into each of the nuts 5 fitted into their respective recessed portions of the partition portion 2*b* of the fusible link housing 2, whereby a terminal 8 formed in a substantially annular round shape and having an electric wire 7 connected by pressure thereto can be connected to each of the leg portions 4*a* of the fusible link 4.

By the way, a similar structure to the above-mentioned fusible link box 1 is disclosed in Japanese Utility Model Unexamined Publication No. Hei. 4-61837, while similar structures to the terminal 8 used in the above box 1 are respectively disclosed in Japanese Utility Model Unexamined Publication No. Hei. 6-62466 and in Japanese Utility Model Unexamined Publication No. Sho. 58-91878.

However, in the above-mentioned conventional structure for connecting the fusible link 4 to the terminal 8, since the bolt 6 is actually tightened into the nut 5 to thereby connect the fusible link 4 and terminal 8 to each other in a wire harness manufacturing process, when the bolt 6 is threadedly engaged with the nut 5, if the bolt 6 is tightened obliquely, as shown by reference character A in FIG. 11, then there is produced an incompletely threadedly engaged portion between the nut 5 and bolt 6, which raises a fear that the fusible link 4 and terminal 8 can be connected together in a poor condition. Although a torque check is executed after the fusible link 4 and terminal 8 are connected together, because a tightening torque is generated even if the bolt 6 is tightened obliquely, it is difficult to detect whether the bolt 6 is tightened obliquely or not.

SUMMARY OF THE INVENTION

In view of this, the present invention aims at solving the above-mentioned problem found in the conventional structure. Accordingly, it is an object of the invention to provide a method for mounting a fusible link as well as a terminal and a fusible link housing used in the same method, which can prevent occurrence of the obliquely tightened state of a bolt used to connect a fusible link and a terminal to each other, and can position and fix the terminal at a normal position, namely, at a proper position, thereby being able to enhance the efficiency of the fusible link mounting operation.

In attaining the above object, according to the invention, there is provided a fusible link mounting method in which a fusible link is mounted onto a fusible link housing, and a leg portion of the fusible link and a terminal of an electric wire are tightened and connected to each other by a bolt, the method comprising the steps of: previously tightening the bolt provisionally with respect to the fusible link housing; sliding and inserting the terminal including a bridge portion so formed as to be able to pass outside a head portion of the bolt provisionally tightened in a direction at right angles to a bolt tightening direction to thereby position a connecting portion of the terminal between the head portion of the bolt and the leg portion of the fusible link; and tightening the bolt actually to thereby connect the leg portion of the fusible link and the connecting portion of the terminal to each other.

Further, there is provided a fusible link mounting method in which a fusible link is mounted onto a fusible link housing, and a leg portion of the fusible link and a terminal of an electric wire are tightened and connected to each other by a bolt, the method comprising the steps of: previously tightening the bolt provisionally with respect to the fusible link housing; sliding and inserting the terminal including a bridge portion so formed as to be able to pass outside a head portion of the bolt provisionally tightened in a direction at right angles to a bolt tightening direction to thereby position a connecting portion of the terminal between the head portion of the bolt and the leg portion of the fusible link; when the terminal is slid and inserted, securing the bridge portion of the terminal by flexible securing portions provided in a front portion of the fusible link housing and existing in the sliding and inserting direction of the terminal; and tightening the bolt actually to thereby connect the leg portion of the fusible link and the connecting portion of the terminal to each other.

Further, there is provided a terminal for use in a fusible link mounting method in which a fusible link is mounted onto a fusible link housing, and a leg portion of the fusible link and the terminal of an electric wire are tightened and connected to each other by a bolt, the terminal comprising: a bridge portion standing up vertically and having a space allowing the bridge portion to pass outside a head portion of the bolt; a U-plate-shaped connecting portion to be connected to the leg portion of the fusible link; and a clamping portion to which the electric wire is to be attached and connected by pressure.

Furthermore, there is provided a fusible link housing for use in a fusible link mounting method in which a fusible link is mounted onto a fusible link housing, and a leg portion of the fusible link and a terminal of an electric wire are tightened and connected to each other by a bolt, the fusible link housing comprising flexible securing portions which are provided at given positions thereof and by which a bridge portion of the terminal passing outside a head portion of the bolt is secured.

BRIEF DESCRIPTION OF THE DRAWINGS

FIG. 2(*b*) is an explanatory view of a state of the terminal in which the sliding thereof is ended;

FIG. 4(*b*) is an explanatory view of the obliquely tightened state of the bolt;

FIG. 6(*b*) is a plan view of the terminal and the bolt in the above-mentioned actually tightened state;

DETAILED DESCRIPTION OF THE PREFERRED EMBODIMENTS

Now, description will be given below of the embodiments of the invention with reference to the accompanying drawings.

Figure 1:
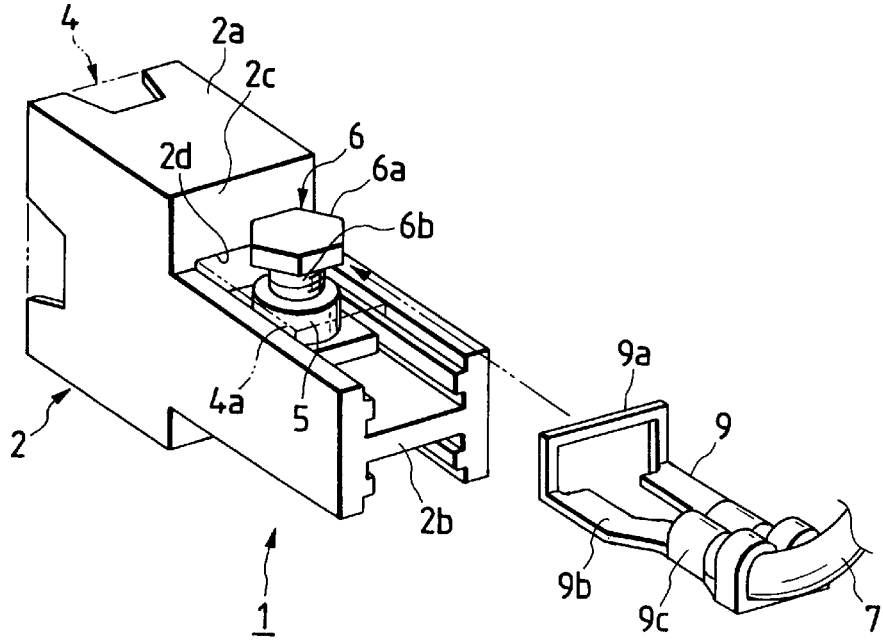
FIG. 1 is a perspective view of a first embodiment of a fusible link box according to the invention, showing a state thereof before a fusible link and a terminal are connected to each other.
Figure 3:
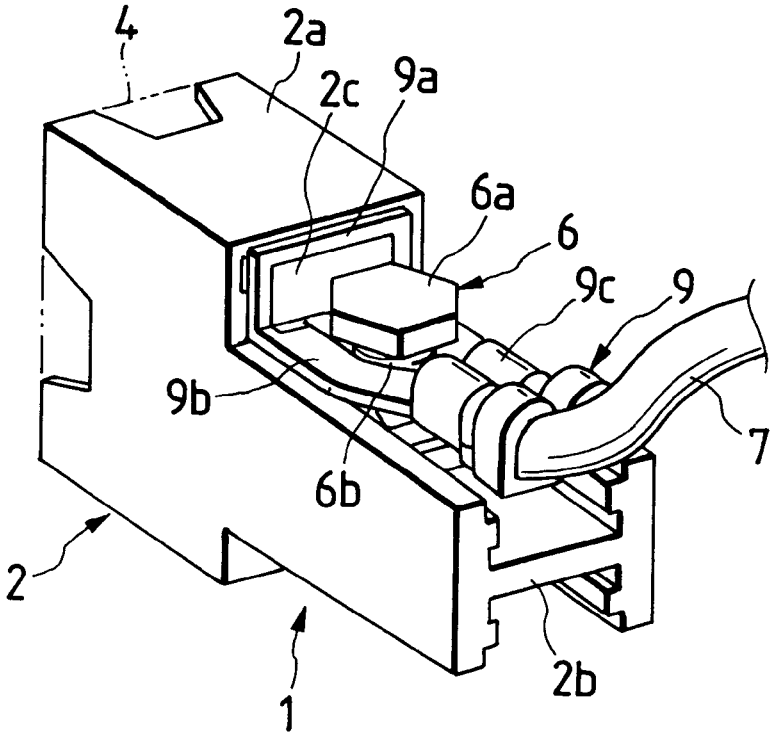
FIG. 3 is a perspective view of the above fusible link box, showing a state thereof in which the connection between the fusible link and the terminal is completed.

FIGS. 1 and 3 are respectively perspective views of a fusible link box according to a first embodiment of the invention. In particular, the present fusible link box 1 includes a fusible link housing 2 which is formed of synthetic resin. The fusible link housing 2 includes a box-shaped front portion 2*a* in which the main body side of a fusible link 4 is to be stored and mounted, and a partition portion 2*b* which has an H-shaped cross section forms an upper and a lower recess portion, into which a pair of leg portions (tab-shaped terminals) 4*a* and 4*a* of the fusible link 4 are to be inserted. Nuts 5, each of which includes a square-plate-shaped lower portion and a cylindrically-shaped upper portion, are respectively fitted in the upper and lower recessed portions of the partition portion 2*b*.

Figure 2A:
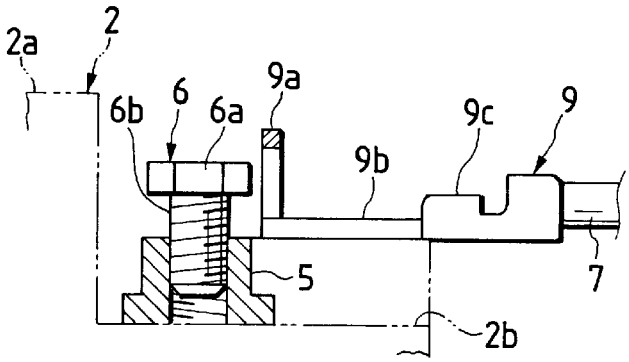
FIG. 2(*a*) is an explanatory view of a state of the terminal in which the terminal is being slid.
Figure 2B:
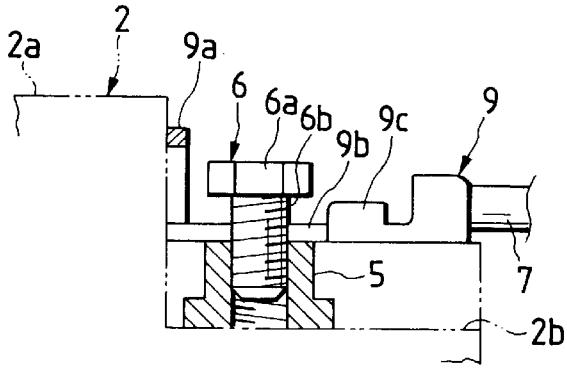

In the central portion of a side wall 2*c* of the front portion 2*a* of the fusible link housing 2, there are formed a pair of openings 2*d* and 2*d* which respectively communicate with the respective recessed portions of the partition portion 2*b*; that is, the respective leg portions 4*a* of the fusible link 4 are allowed to project toward the partition portion 2*b* side through the respective openings 2*d*. Also, as shown in FIGS. 1, 2(*a*) and 2(*b*), a bolt 6, which is used to connect each of the leg portions 4*a* of the fusible link 4 to a terminal 9 with an electric wire 7 connected by pressure thereto, is previously tightened provisionally into the nut 5 (while the fusible link box 1 is held in such a manner that the parts thereof are disposed separately as single parts and are not yet assembled together). Further, the terminal 9 includes a U-shaped bridge portion 9*a* standing up vertically and having a space allowing the bridge portion 9*a* to pass outside a head portion 6*a* of the provisionally tightened bolt 6, a U-plate-shaped connecting portion 9*b* to be connected to each of the leg portions 4*a* of the fusible link 4, and a clamping portion 9*c* to which the electric wire 7 can be attached and connected by pressure. By the way, in the central portion of each of the leg portions 4*a* of the fusible link 4, there is formed a round hole (not shown) through which a shank portion 6*b* of the bolt 6 can pass.

Figure 4A:
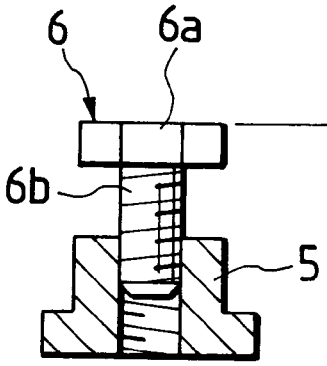
FIG. 4(*a*) is an explanatory view of the properly threadedly engaged state of a bolt used to connect the fusible link and the terminal to each other.
Figure 4B:
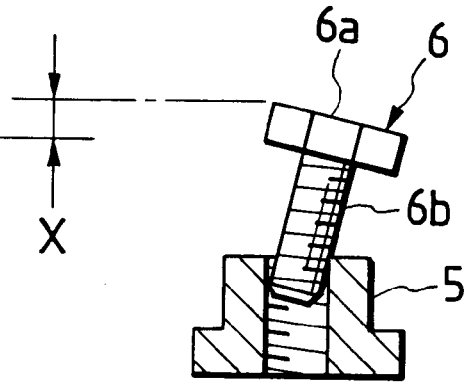

In the fusible link box 1 according to the above-mentioned first embodiment of the invention, as shown in FIG. 1, in the parts unassembled state thereof, the fusible link 4 is previously set in the front portion 2*a* of the fusible link housing 2 prior to the provisional tightening of the bolt and, after such previous setting of the fusible link 4, the bolt 6 is also previously tightened provisionally into the nut 5 arranged in each of the recessed portions of the partition portion 2*b* of the fusible link housing 2 by an automatically threadedly engaging machine (not shown) or the like. As shown in FIG. 4(*b*), if the oblique tightened state is generated in the bolt 6, then the bolt 6 is caused to vary in position by a variation amount X between the normally threadedly engaged state while the bolt 6 is provisionally tightened, which is shown in FIG. 4(*a*), and the obliquely tightened state of the bolt 6 shown in FIG. 4(*b*). Therefore, if this variation amount X is detected by a detector (not shown) or the like, then it is possible to confirm whether the obliquely tightened state of the bolt 6 is present or not.

Then, in a wire harness manufacturing process, using only the above-mentioned fusible link housing 2 with the bolt 6 provisionally tightened in the normally threadedly engaged state, as shown in FIGS. 2(*a*) and 2(*b*), the terminal 9 including the bridge portion 9*a* so formed as to be able to pass outside the head portion 6*a* of the provisionally tightened bolt 6 is slid and inserted onto the partition portion 2*b* of the fusible link housing 2 extending in a direction at right angles to the bolt tightening direction to thereby position the connecting portion 9*b* of the terminal 9 between the head portion 6*a* of the bolt 6 and the leg portion 4*a* of the fusible link 4; and, after then, the bolt 6 is actually tightened by an impact wrench (not shown) or the like to thereby connect the leg portion 4*a* of the fusible link 4 and the connecting portion 9*b* of the terminal 9 to each other.

Here, in FIG. 3, there is shown the final mounting step of the fusible link 4, that is, the final state of the fusible link box 1 in which the bolt 6 has been actually tightened. As described above, since the assembling of the bolt 6 that is easiest to cause the bolt 6 to be obliquely tightened is executed not in the wire harness manufacturing process but in the parts unassembled state of the fusible link box 1, namely, in the state thereof where the parts of the fusible link box 1 are arranged separately as single parts before they are actually assembled, when the obliquely tightened state of the bolt 6 occurs, such obliquely tightened state can be detected more easily. Also, because there is eliminated the need to carry out the bolt assembling operation in the wire harness manufacturing process, the efficiency of the assembling operation of the fusible link box 1 can be enhanced. Further, the prevention of occurrence of the obliquely tightened state of the bolt 6 makes it possible to connect the leg portion 4*a* of the fusible link 4 and the connecting portion 9*b* of the terminal 9 to each other always in a proper and positive manner. In addition to this, since the terminal 9 is manufactured in such a manner that the vertically standing-up bridge portion 9*a*, the U-plate-shaped connecting portion 9*b*, and the clamping portion 9*c* are respectively formed integrally with each other by blanking and bending, the strength of the whole terminal 9 can be improved, so that, even when the terminal 9 is slid and inserted toward the head portion 6*a* side of the bolt 6, the terminal 9 can be moved smoothly and positively.

Figure 5:
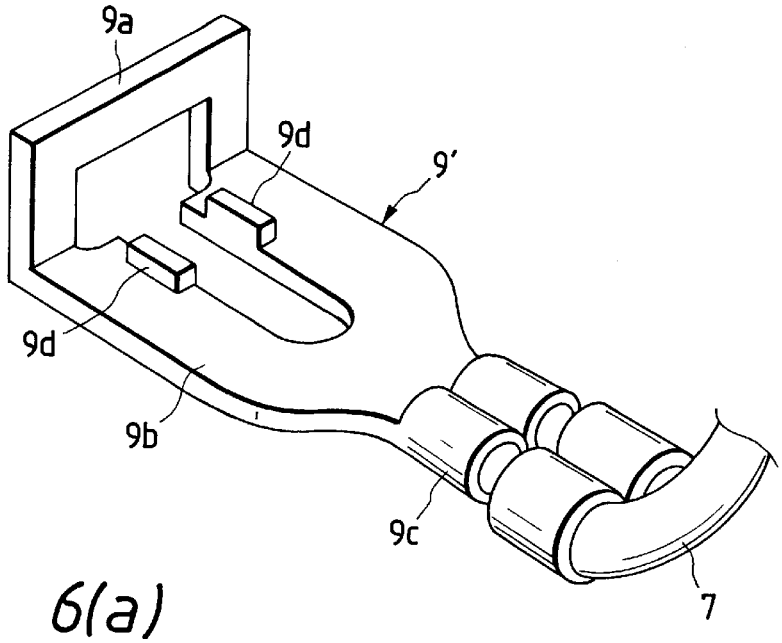
FIG. 5 is a perspective view of a terminal in a second embodiment of the invention.

Now, FIG. 5 is a perspective view of a terminal in a second embodiment of the invention. Also, FIG. 6(*a*) is an explanatory view of a state in which the present terminal is actually tightened with a bolt, while FIG. 6(*b*) is a plan view of the terminal and the bolt in the actually tightened state. The present terminal 9' in the second embodiment, similarly to the terminal 9 in the first embodiment shown in FIGS. 1 to 3, includes a U-shaped bridge portion 9*a* standing up vertically and having a space allowing the U-shaped bridge portion 9*a* to pass outside the head portion 6*a* of the provisionally tightened bolt 6, a U-plate-shaped connecting portion 9*b* which can be connected to each of the leg portions 4*a* of the fusible link 4, and a clamping portion 9*c* to which the electric wire 7 can be attached and connected by pressure.

Figure 6A:
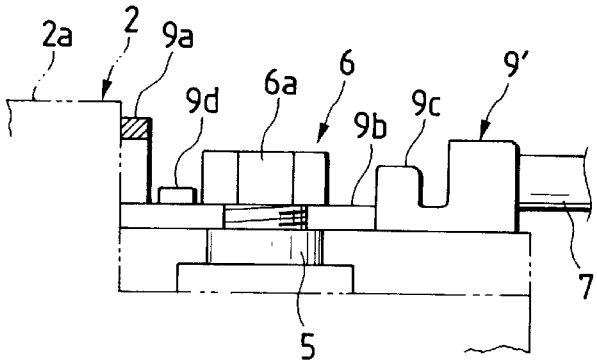
FIG. 6(*a*) is an explanatory view of a state in which the terminal in the second embodiment is actually tightened by a bolt.
Figure 6B:
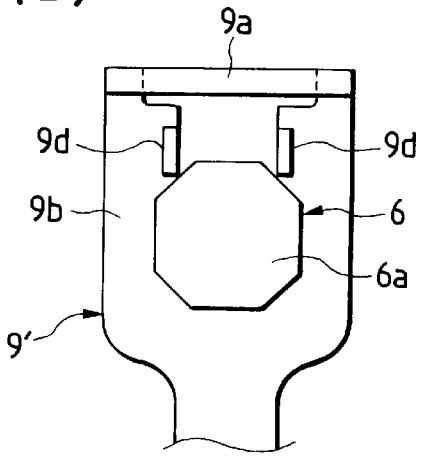

As shown in FIG. 6(*b*), at the positions of the mutually opposed cut inner edges of the U-plate-shaped connecting portion 9*b* that are respectively present near to the bridge portion 9*a*, by bending the present cut inner edges upwardly, there are provided a pair of rectangular-shaped ribs 9*d* and 9*d* in a projecting manner; that is, the ribs 9*d* can be respectively butted against the two sides of the peripheral surface of the head portion 6*a* of the actually tightened bolt 6 to thereby prevent the connecting portion 9*b* of the terminal 9' from being removed from the head portion 6*a* of the bolt 6.

In the terminal 9' of the second embodiment, when the electric wire 7 is pulled and the terminal 9' connected to the present electric wire 7 is thereby pulled, the mutually opposed pair of ribs 9*d* and 9*d* of the U-plate-shaped connecting portion 9*b* of the present terminal 9' interfere with the head portion 6*a* of the actually tightened bolt 6 to thereby prevent the terminal 9' from shifting in position any further, so that a sufficient force to hold the terminal 9' can be secured by the ribs 9*d* to be butted against the head portion 6*a* of the bolt 6.

Figure 7:
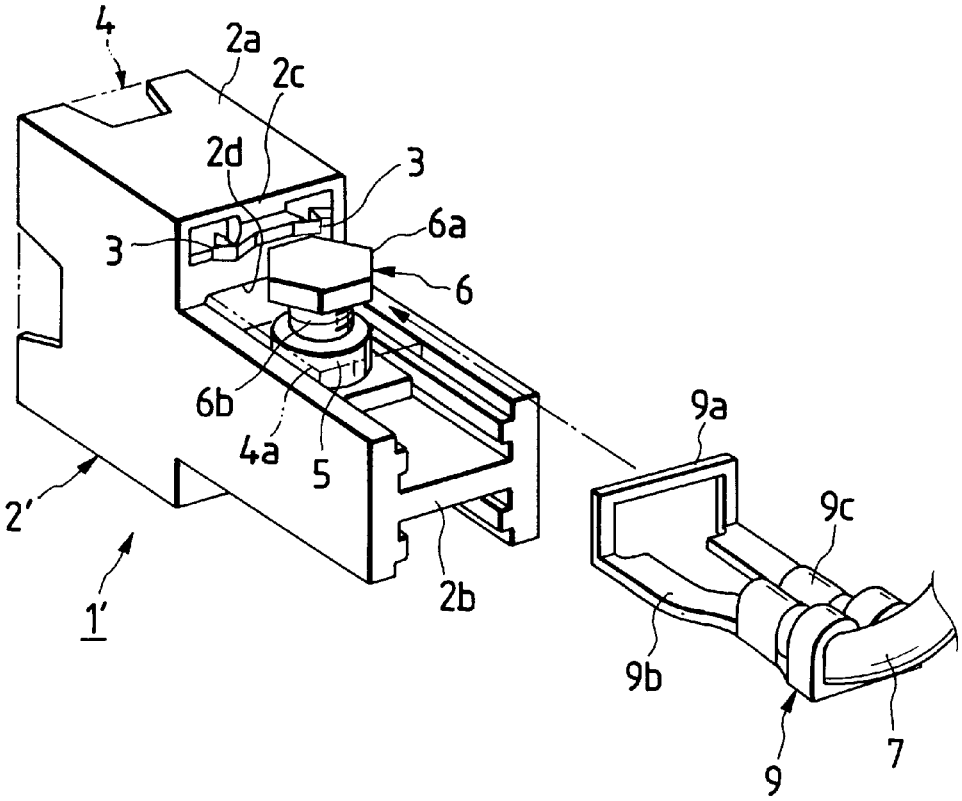
FIG. 7 is a perspective view of a fusible link box in a third embodiment of the invention, showing a state thereof before a fusible link and a terminal are connected to each other.
Figure 8:
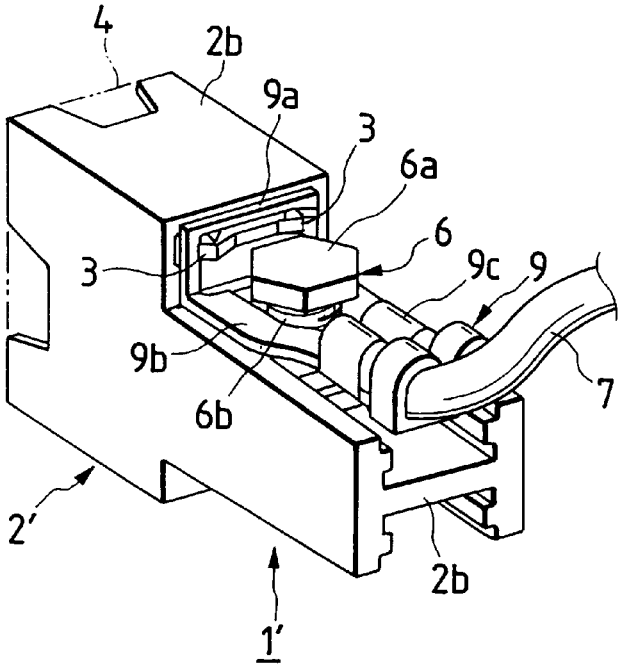
FIG. 8 is a perspective view of the fusible link box, showing a state thereof in which the connection between the fusible link and the terminal is completed.

Now, FIGS. 7 and 8 are respectively perspective views of a fusible link box in a third embodiment of the invention. In the present fusible link box 1', in more particular, on the upper and lower sides of a side wall 2*c* of a front portion 2*a* of a fusible link housing 2' thereof, there are integrally and projectingly provided a pair of flexible securing portions 3 and 3 to which the two sides of the bridge portion 9*a* of the terminal 9 passing outside the head portion 6*a* of the bolt 6 can be respectively secured. In the present fusible link box 1', the remaining portions of the structure thereof are similar to the previously described first embodiment shown in FIGS. 1 and 3 and, therefore, the same parts as in the first embodiment are given the same designations and thus the detailed description thereof is omitted here.

Figure 9:
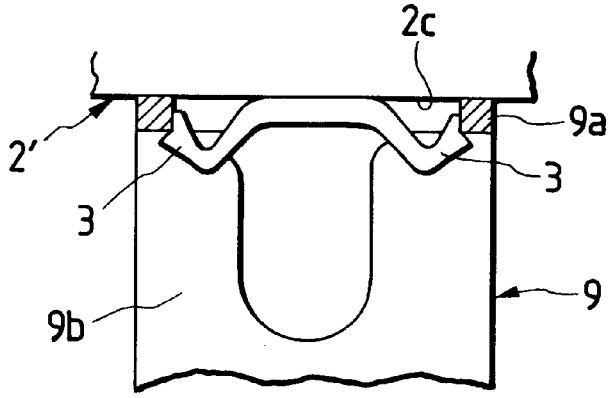
FIG. 9 is an explanatory view of the main portions of the third embodiment when the sliding of the terminal is ended.
Figure 10:
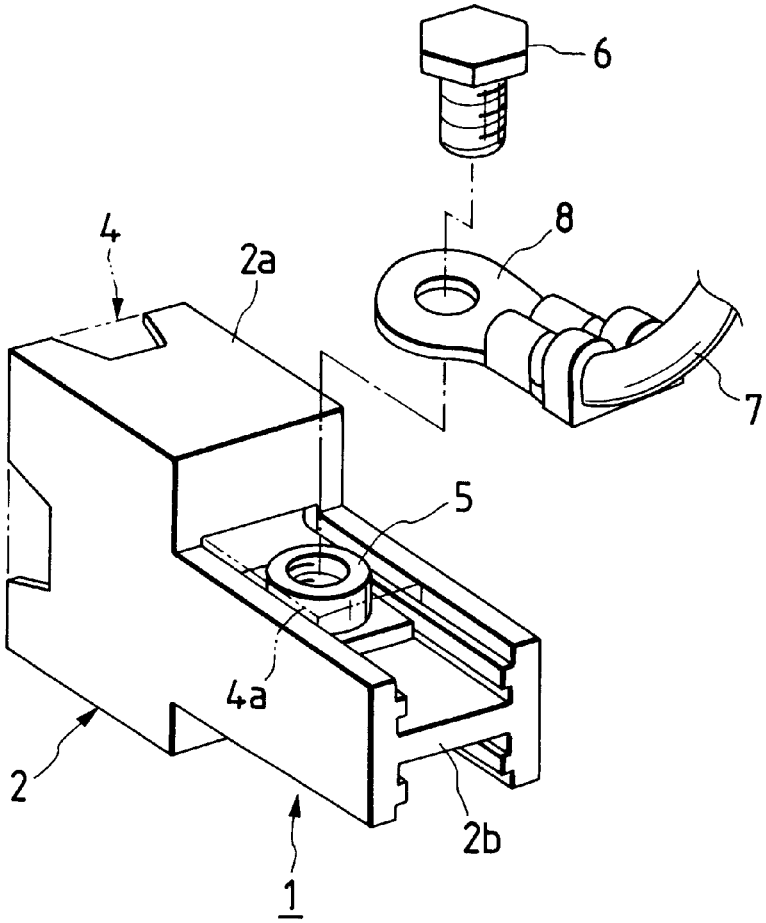
FIG. 10 PRIOR ART
FIG. 10 is a perspective view of a conventional fusible link box, showing a state thereof before a fusible link and a terminal are connected to each other.
Figure 11:
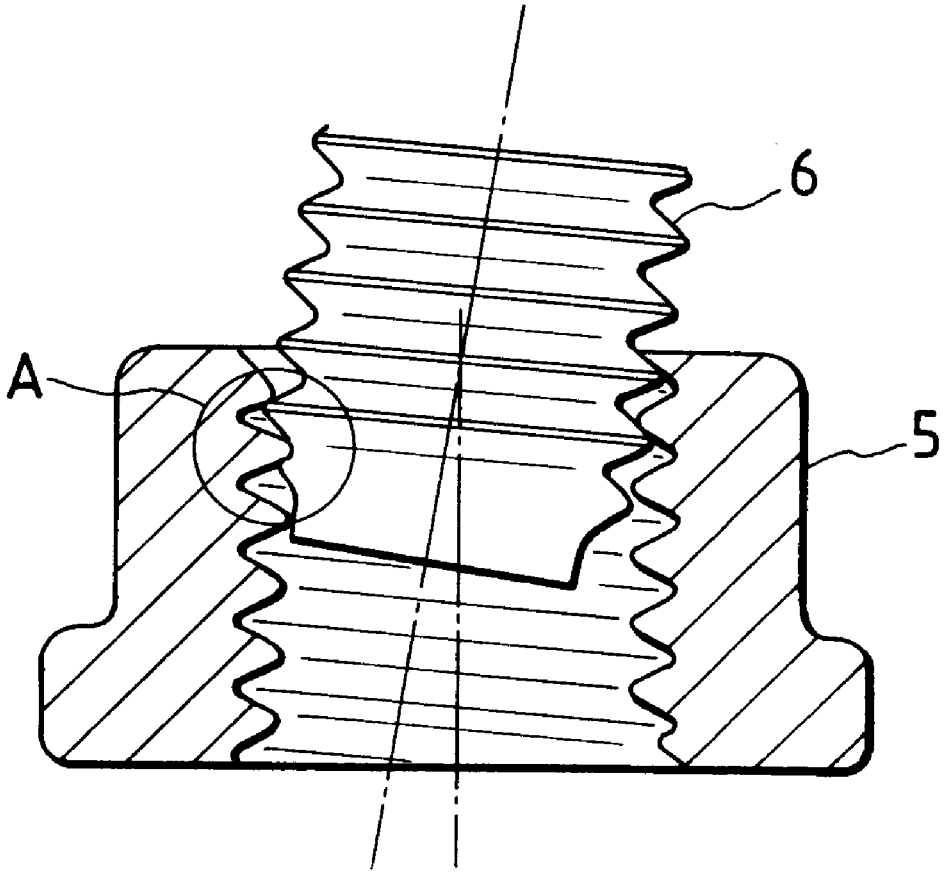
FIG. 11 PRIOR ART
FIG. 11 is an explanatory view of the obliquely tightened state of a bolt for connecting the fusible link and the terminal in the conventional fusible link box.

In the fusible link box 1' of the third embodiment, when the terminal 9 is slid and inserted toward the head portion 6*a* of the bolt 6 on the partition portion 2*b* of the fusible link housing 2', as shown in FIGS. 8 and 9, the two sides of the bridge portion 9*a* of the terminal 9 are respectively secured by the flexible securing portions 3 and 3 which are projectingly and integrally provided on the side wall 2*c* of the fusible link housing 2', and the bolt 6 is next actually tightened with an impact wrench or the like, thereby connecting the leg portion 4*a* of the fusible link 4 and the connecting portion 9*b* of the terminal 9 to each other.

With use of the present method for mounting the fusible link 4, since the respective upper portions of the two sides of the bridge portion 9*a* of the terminal 9 can be surely held and fixed by means of the respective flexible securing portions 3 of the side wall 2*c* of the fusible link housing 2', when the bolt 6 is actually tightened with an impact wrench or the like, there is no possibility that the impact wrench or the like can be butted against the bridge portion 9*a* of the terminal 9, which makes it possible to position and fix the terminal 9 to a proper position. Also, due to the enhanced holding force of the terminal 9, even if the electric wire 7 is pulled after the bolt 6 is actually tightened, there is no fear that the terminal 9 can be shifted out of its properly fixed position, thereby being able to always keep the connection between the leg portion 4*a* of the fusible link 4 and the connecting portion 9*b* of the terminal 9 in an excellent condition.

By the way, in the above-mentioned respective embodiments of the invention, description has been given of the method for mounting a threadedly mounting type of fusible link which requires a high current characteristic, but the present invention can also apply to a method for mounting a fusible link having a low current characteristic. Also, according to the above-mentioned respective embodiments, there is employed a fusible link including in each of the leg portions thereof a round hole through which the shank portion of a bolt can extend. However, the invention is not limited to this but, for example, there can be used a fusible link including in each of the leg portions thereof, instead of the round hole, a U-shaped recessed portion through which the shank portion of a bolt can extend; that is, after the bolt is tightened provisionally, the fusible link can be set in the front portion of the fusible link housing.

As has been described heretofore in detail, according to the fusible link mounting method of the invention, before the bolt is actually tightened to thereby connect the leg portion of the fusible link and the connecting portion of the terminal to each other, the bolt is previously tightened provisionally with respect to the fusible link housing. Thanks to this, when an obliquely tightened state happens to occur in the bolt, the occurrence of such state can be detected more easily; that is, the obliquely tightened bolt can be prevented to thereby be able to connect the leg portion of the fusible link and the connecting portion of the terminal to each other always in an excellent connecting condition.

According to the terminal of the invention, because the vertically standing-up bridge portion and U-plate-shaped connecting portion of the terminal are connected to each other, the strength of the terminal can be enhanced, thereby being able to move the terminal smoothly and positively even when the terminal is slid and inserted toward the head portion side of the bolt.

According to the fusible link housing of the invention, because the terminal can be positioned positively at a given position in the fusible link housing by means of the flexible securing portions respectively formed in the fusible link housing, the terminal holding force can be enhanced, which makes it possible to prevent the terminal from shifting in position even if a tensile force or the like is applied to the electric wire.

What is claimed is:

1. A fusible link mounting method in which a fusible link is mounted onto a fusible link housing, and a leg portion of the fusible link and a terminal of an electric wire are tightened and connected to each other by a bolt, said method comprising the steps of: provisionally tightening the bolt with respect to the fusible link housing;

sliding and inserting the terminal having a bridge portion formed so as to be able to pass outside a head portion of the bolt, which has been provisionally tightened, in a direction at right angles to a bolt tightening direction to thereby position a connecting portion of the terminal between the head portion of the bolt and the leg portion of the fusible link; and tightening the bolt to thereby connect the leg portion of the fusible link and the connecting portion of the terminal to each other.

2. A fusible link mounting method in which a fusible link is mounted onto a fusible link housing, and a leg portion of the fusible link and a terminal of an electric wire are tightened and connected to each other by a bolt, said method comprising the steps of:

provisionally tightening the bolt with respect to the fusible link housing;

sliding and inserting the terminal having a bridge portion formed so as to be able to pass outside a head portion of the bolt, which has been provisionally tightened, in a direction at right angles to a bolt tightening direction to thereby position a connecting portion of the terminal between the head portion of the bolt and the leg portion of the fusible link;

securing the bridge portion of the terminal by flexible securing portions provided in a front portion of the fusible link housing, in the sliding and inserting direction of the terminal; and tightening the bolt to thereby connect the leg portion of the fusible link and the connecting portion of the terminal to each other.

3. A terminal for use in a fusible link mounting method in which a fusible link is mounted onto a fusible link housing, and a leg portion of the fusible link and the terminal of an electric wire are tightened and connected to each other by a bolt, said terminal comprising:

a bridge portion standing up vertically and having a space allowing said bridge portion to pass outside a head portion of the bolt;

a U-plate-shaped connecting portion to be connected to the leg portion of the fusible link; and a clamping portion to which the electric wire is to be attached and connected by pressure.

4. The terminal as set forth in claim 3, wherein ribs are projectingly provided on said U-plate-shaped connecting portion and are butted against the head portion of the bolt tightened to thereby prevent said connecting portion from being removed from the bolt.

5. A fusible link housing for use in a fusible link mounting method in which a fusible link is mounted onto said fusible link housing, and a leg portion of the fusible link and a terminal of an electric wire are tightened and connected to each other by a bolt, said fusible link housing comprising flexible securing portions which are provided at given positions thereof and by which a bridge portion of the terminal passing outside a head portion of the bolt is secured.

6. The fusible link housing as set forth in claim 5, wherein said flexible securing portions are integrally and projectingly provided on a side wall of said fusible link housing.

* * * * *